US005228676A

United States Patent [19]

Arai et al.

[11] Patent Number: 5,228,676

[45] Date of Patent: Jul. 20, 1993

[54] SHEET FEEDING EQUIPMENT

[75] Inventors: Kiyotaka Arai; Masahiko Nakao, both of Osaka, Japan

[73] Assignee: Mita Industrial Co., Ltd., Osaka, Japan

[21] Appl. No.: 912,995

[22] Filed: Jul. 14, 1992

[30] Foreign Application Priority Data

Jul. 24, 1991 [JP] Japan ..... 3-184553

[51] Int. Cl.[5] ..... B65H 3/00

[52] U.S. Cl. ..... 271/117; 271/126; 271/157; 271/164

[58] Field of Search ..... 271/117, 118, 126, 127, 271/157, 164, 162

[56] References Cited

U.S. PATENT DOCUMENTS 4,763,891 8/1988 Kodama ..... 271/157

FOREIGN PATENT DOCUMENTS 82238 5/1984 Japan ..... 271/157
255324 11/1987 Japan ..... 271/157
53934 3/1989 Japan ..... 271/164
270737 11/1990 Japan ..... 271/162
3-98927 4/1991 Japan ..... 271/162

*Primary Examiner*—H. Grant Skaggs
*Attorney, Agent, or Firm*—Beveridge, DeGrandi, Weilacher & Young

[57] ABSTRACT

A sheet feeding apparatus provided with an urging device to urge the lift shaft, the lift gear or the lift plate in a direction opposite the insertion direction of the sheet feeding cassette, so as to disengage the lift shaft from the lift shaft drive. Insertion of the sheet feeding cassette pushes the lift shaft, lift gear or lift plate against the urging device, thereby engaging the lift shaft with the lift shaft drive. Alternately, rather than employing the urging device, the sheet feeding cassette may pull the lift shaft out of engagement with the lift drive by pulling the lifted lift plate in direction opposite the insertion direction of the sheet feeding cassette.

23 Claims, 12 Drawing Sheets

SHEET FEEDING EQUIPMENT

BACKGROUND OF THE INVENTION

1. Field of the Invention

The present invention relates to a sheet feeding equipment of image forming apparatus.

2. Description of the Related Art

Heretofore, as shown in FIG. 1, an image forming apparatus is provided with a sheet feeding cassette 1 which has a cassette plate 12 for placing a sheet 101 thereon and in which an opening 9 is provided on a part of a side plate and a bottom plate 30; with a pick up roller 10 for feeding the sheet 101 from the sheet feeding cassette 1; with a lift plate 2 for lifting the cassette plate 12 on which the sheet 101 has been placed to abut the sheet 101 against the pick up roller 10; with a lift shaft 3 to which one end of the lift plate 2 is fixed by a machine screw and the like; with a lift gear 4 fixed to an end of the lift shaft 3; with an idle gear 13 engaging with a gear section 14 of the lift gear 4; and with drive means 6 formed by a motor 22 and gear means 5 for pivoting the lift gear 4, the lift shaft 3 and lift plate 2, through the idle gear 13.

Now, when an image forming apparatus attempts to feed the sheet 101 for copying, in order to abut the sheet 101 placed on the cassette plate 12 against the pick up roller 10, the motor 22 rotates to cause the lift gear 4 through the gear means 5 and the idle gear 13 to be driven to the lower side on the view, the lift shaft 13 to be rotated, and the lift plate 2 fixed to the shaft 3 to be pivoted to the upper side. Hereby, as shown in FIG. 1, the lift plate 2 passes through an opening 9 of the sheet feeding cassette 1, whereby a tip 31 thereof abuts the cassette plate 12 and lifts the cassette plate 12 together with the sheet 101, and when the sheet 101 reaches a position at which the sheet abuts the pick up roller 10, the plate 2 stops pivoting.

When the sheet 101 abuts the pick up roller 10, the pick up roller 10 can feed the sheet 101 to the a sheet feeding roller 23, whereby the feeding of the sheet 101 is performed.

Now, if the sheet feeding cassette 1 is pulled out accidentally during the feeding of the sheet 101 by the pick up roller 10, as shown in FIG. 2, an edge of the opening 9 of the sheet feeding cassette 1 hits an edge 21 of the lift plate 2 having been lifted, to cause the sheet feeding cassette 1 or the lift plate 2 to be damaged. Therefore, heretofore, a lock device has been provided to prevent a trouble due to the pulling out of the sheet feeding cassette 1 during sheet feeding.

However, a sheet feeding equipment provided with such lock device has problems that where the lift plate is positioned at a sheet feeding position, the sheet feeding cassette cannot be pulled out, and that the equipment is complex and expensive.

SUMMARY OF THE INVENTION

Considering such problems of the sheet feeding equipment of prior art, an object of the present invention is to provide a sheet feeding equipment in which where the lift plate is positioned at a sheet feeding position, the sheet feeding cassette can be pulled out, and which is simple in structure and inexpensive.

That is, the present invention set forth in claim 1 is such that;

When a sheet feeding cassette is inserted, a protrusion of the sheet feeding cassette pushes a lift shaft, a lift plate or a lift gear against the urging force of urging means, to cause the lift gear to engage with a gear of drive means, allowing the lift plate to be pivoted by the drive means, while when the sheet feeding cassette is pulled out, the protrusion of the sheet feeding cassette does not push the lift shaft, the lift plate or the lift gear, and by the urging force, the urging means release the lift gear from the gear of the drive means, whereby the lift shaft becomes free and the lift plate is pivoted by the weight thereof or of the sheet to the underside of the sheet feeding cassette, allowing the sheet feeding cassette to be pulled out.

One embodiment of the present invention is such that when a sheet feeding cassette is inserted, a protrusion of the sheet feeding cassette pushes a lift shaft, a lift plate or a lift gear, to cause the lift gear to engage with a gear of drive means, allowing the lift plate to be pivoted by the drive means, while when the sheet feeding cassette is pulled out, the protrusion of the sheet feeding cassette does not push the lift shaft, the lift plate or the lift gear, and an edge of an opening provided to the sheet feeding cassette abuts and pushes an edge of the lift plate having been lifted, to release the lift gear from the gear of the drive means, whereby the lift shaft becomes free and the lift plate is pivoted by the weight thereof or of the sheet to the outside of the sheet feeding cassette, allowing the sheet feeding cassette to be pulled out.

Another embodiment of the present invention is such that drive means drive a lift gear, and a lift plate pivoted lifts a cassette plate and a sheet and pushes up a pick up roller, and when the lift plate reaches a limit position, a gear section of the lift gear is released from a gear of the drive means.

PREFERRED EMBODIMENTS OF THE PRESENT INVENTION

With reference to drawings, embodiments of the present invention will be described hereinafter.

Figure 2:
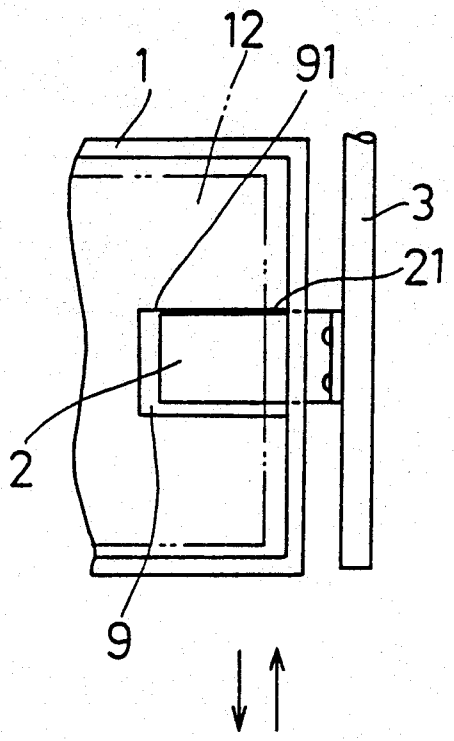
FIG. 2 (PRIOR ART)
FIG. 2 is a plan view of part of a sheet feeding equipment of prior art.
Figure 1:
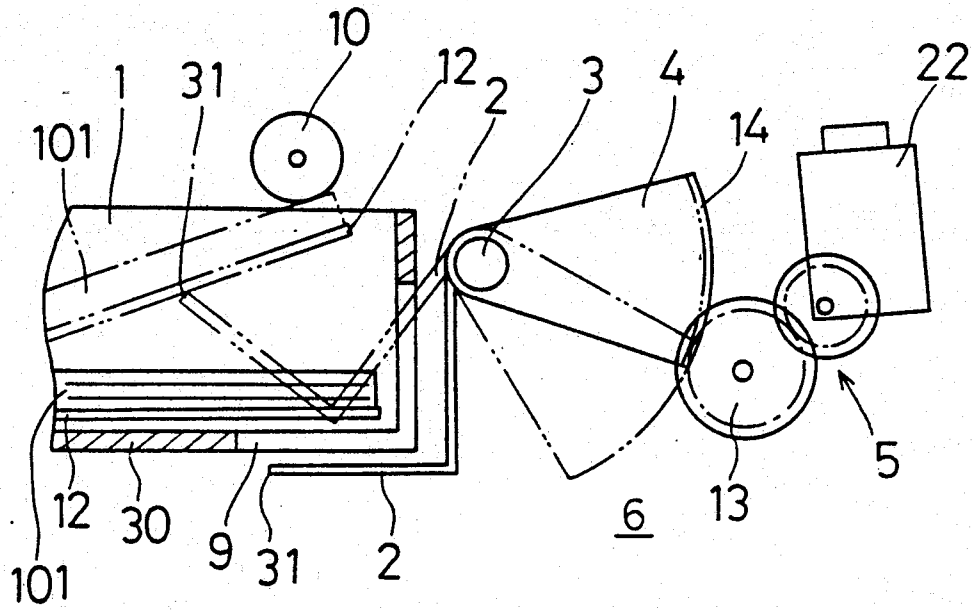
FIG. 1 (PRIOR ART)
FIG. 1 is a schematic side view of part of a sheet feeding equipment of prior art.
Figure 3:
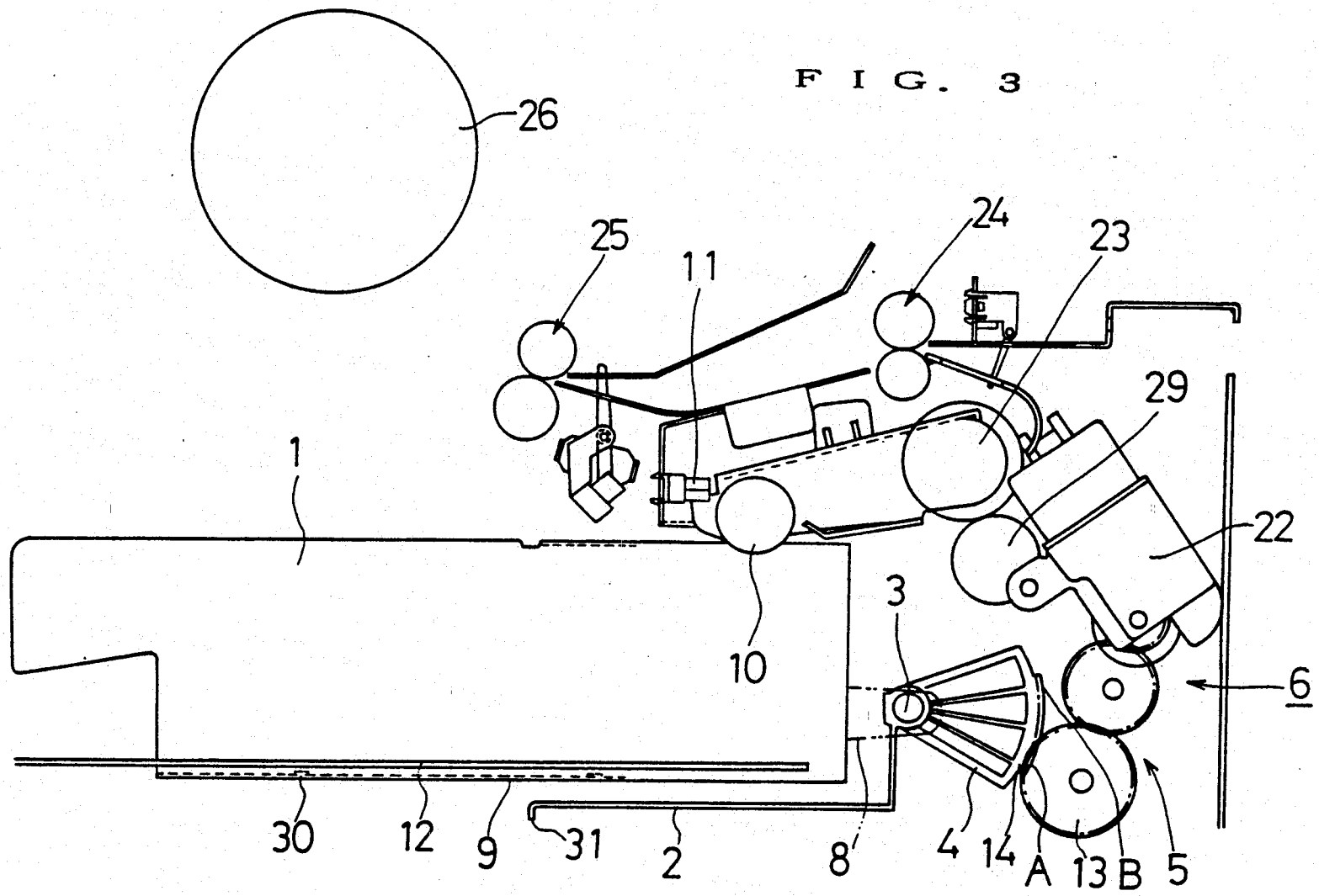
FIG. 3 is a side view of part of an image forming apparatus provided with a sheet feeding equipment of an embodiment according to the present invention.
Figure 5:
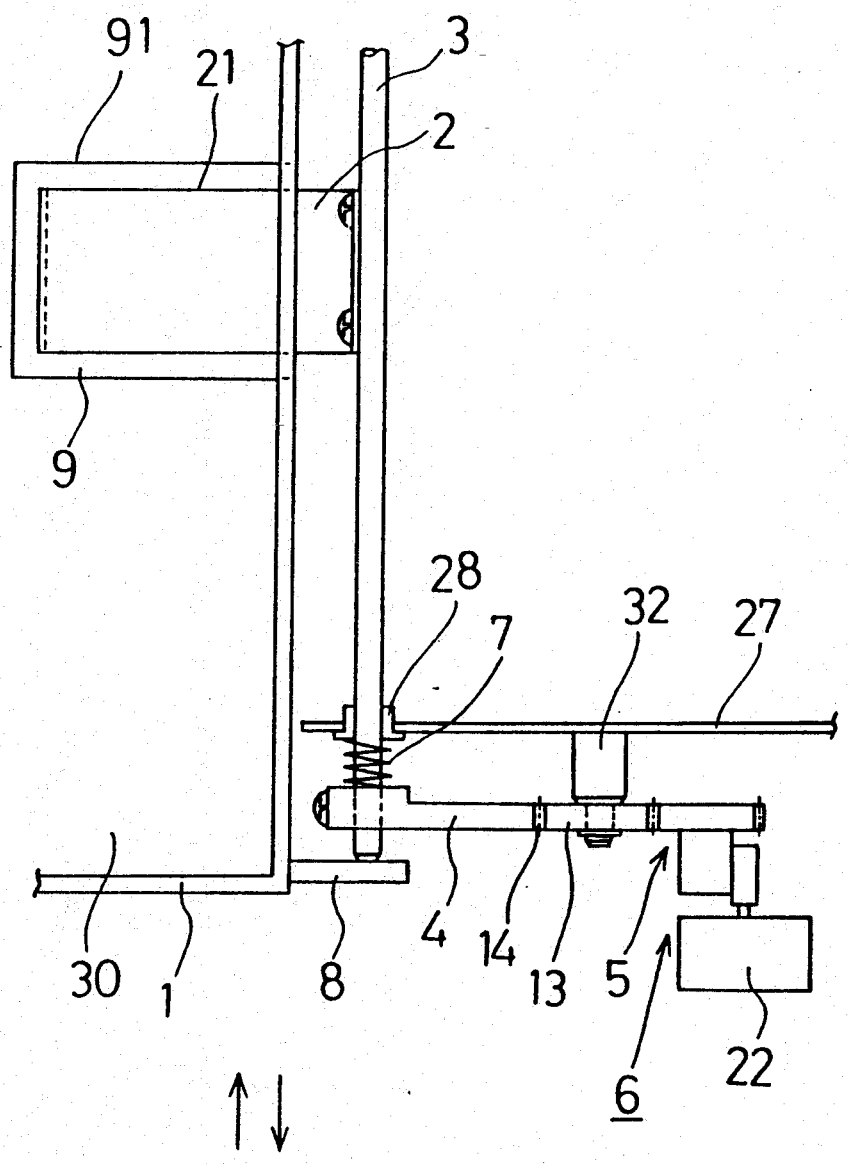
FIG. 5 is a plan view showing an arrangement where a lift gear of the present invention is released from a gear of drive means.

FIG. 3 is a side view of a part of an image forming apparatus provided with a sheet feeding equipment of an embodiment according to the present invention. That is, the image forming apparatus is provided with a sheet feeding cassette 1 which has a cassette plate 12 for placing a sheet thereon and in which an opening 9 is provided on a part of a side and bottom plate 30; with a pick up roller 10 for feeding the sheet from the sheet feeding cassette 1, the pick up roller 10 being capable of being lifted up; with a lift plate 2 for lifting the cassette plate 12 on which the sheet has been placed, to abut the sheet against the pick up roller 10; with a lift shaft 3 to which one end of the lift plate 2 is fixed by a machine screw and the like; with a lift gear 4 having a fan shape and fixed to an end of the lift shaft 3; with an idle gear 13 engaging with a gear section 14 of the lift gear 4; and with drive means 6 formed by a motor 22 and gear means 5 for pivoting the lift gear 4, the lift shaft 3 and lift plate 2, through the idle gear 13. As shown in FIG. 5, on the lower side of the view on the right side of the sheet feeding cassette 1, is provided a protrusion 8 for pushing one end of the lift shaft 3. The protrusion 8 is a plate member.

As shown in the FIG. 3, in a position near the pick up roller 10, is provided position detection means 11 for detecting the position of the sheet as well as that of the pick up roller 10 so that the pick up roller 10 is not excessively pushed up together with the sheet by the pivoting of the lift plate 2, while on the downstream side of the pick up roller 10, are provided a sheet feeding roller 23, a double feeding preventive roller 29, a conveying roller 24 and a pair of resist rollers 25 for feeding the sheet to a photosensitive drum roller 26.

As shown in FIG. 5, in a specified position of a frame 27 of the main body, is provided a bearing 28, by which the lift shaft 3 is penetratingly held (other bearings not shown). The arrow of FIG. 5 shows a moving direction of the sheet feeding cassette 1. Therefore the lift shaft 3 is attached to the main body in a manner to be movable in the direction in which the sheet feeding cassette 1 is mounted/demounted. To the center part of the lift shaft 3 is fixed by a screw the lift plate 2 for lifting the cassette plate 12, while at an end of the lift shaft 3 is fixed by a screw the lift gear 4. Between the lift gear 4 and the frame 27 is provided a spring 7 being urging means for urging the lift gear 4 in the downward direction on the view at all times.

The idle gear 13 engaging with the fear section of the lift gear 4 is mounted to the a fixing shaft 32 mounted to the frame 27, and further engages with the gear means 5 of the drive means 6. On a part of the bottom plate 30 of the sheet feeding cassette 1, is provided the opening 9 wider than the width of the lift plate 2 so that the lift plate 2 can pass through the opening 9.

The operation of the above-described embodiment will be described hereinafter.

Figure 4:
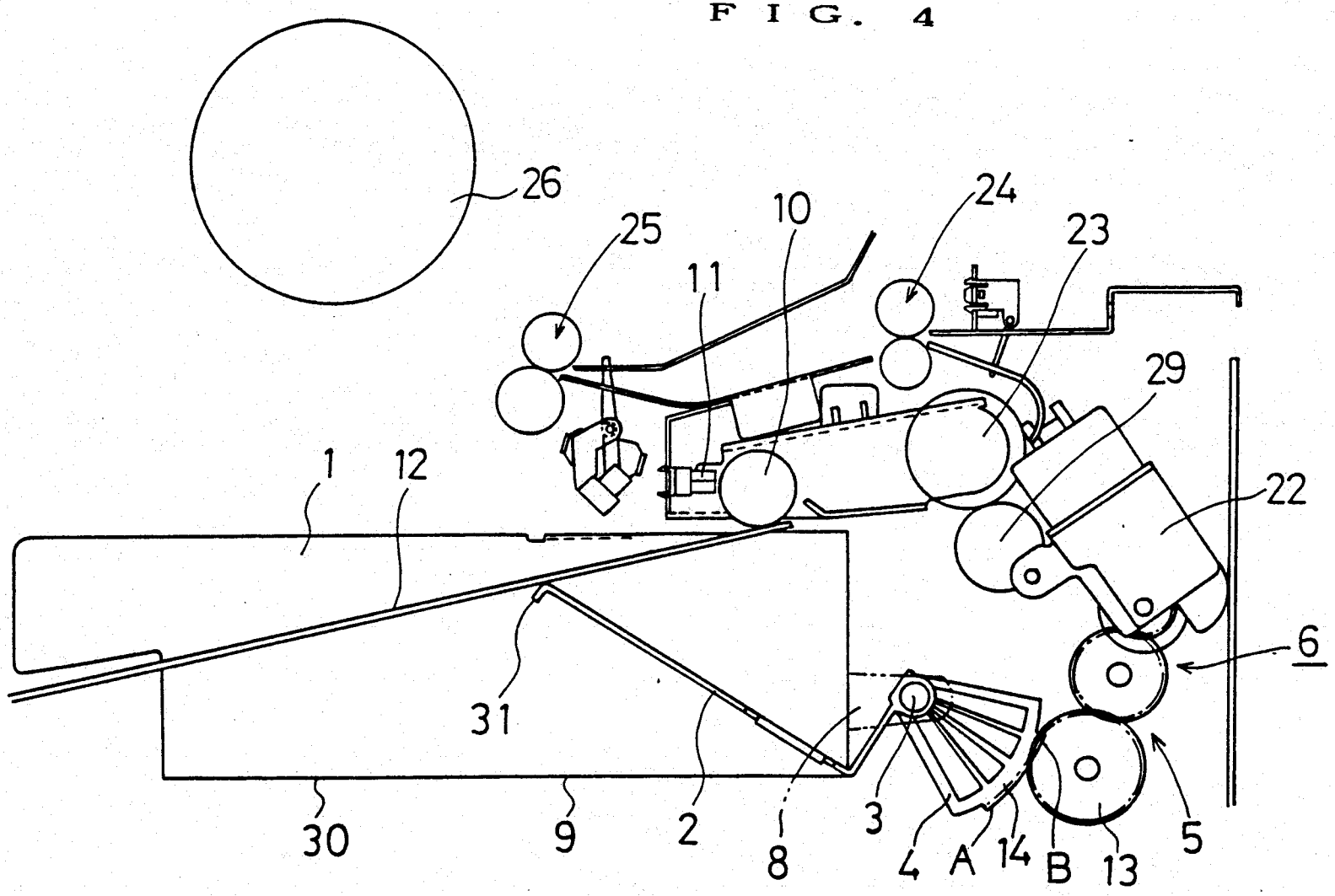
FIG. 4 is a side view of part during sheet feeding of the image forming apparatus provided with the sheet feeding equipment of the embodiment.

Now assume that the sheet feeding cassette 1 has been set to the image forming apparatus as shown in FIG. 5, and the cassette plate 12 has been lifted by a tip 31 (FIG. 4) of the lift plate 2 to feed the sheet as shown in FIG. 4 (the lift plate 2 is in a condition that it enters into the opening 9). At this condition, the lift gear 4 engages with the idle gear 13, whereby the lift plate 2 is locked in a lifted position. The protrusion 8 is pressing the lift shaft 3 against the force of the spring 7.

When the sheet feeding cassette 1 is pulled out in this condition, a protrusion 8 is released from the tip of the lift shaft 3. Then the spring 7 is provided between the frame 27 and the lift gear 4, whereby the urging force thereof causes the lift gear 4 to be pushed and moved in the direction in which the sheet feeding cassette 1 is pulled out. Accordingly, as shown in FIG. 6, the lift plate 2, the lift shaft 3 and the lift gear 4 are moved together with the sheet feeding cassette 1 until the spring 7 is fully expanded, whereby the lift gear 4 is immediately released from the idle gear 13, that is, the drive means 6.

When the lift gear 4 is released from the idle gear 13, the lift shaft 3 becomes rotatable, whereby the lift plate 2 is pushed down rapidly through the opening 9 by the weight of the lifted cassette plate 12 and the sheet. Thus, the lift plate 2 returns to the original position as shown in FIG. 3, and thereby the sheet feeding cassette 1 can be fully pulled out without interfering with the lift plate 2 by the edge of the opening 9.

Figure 6:
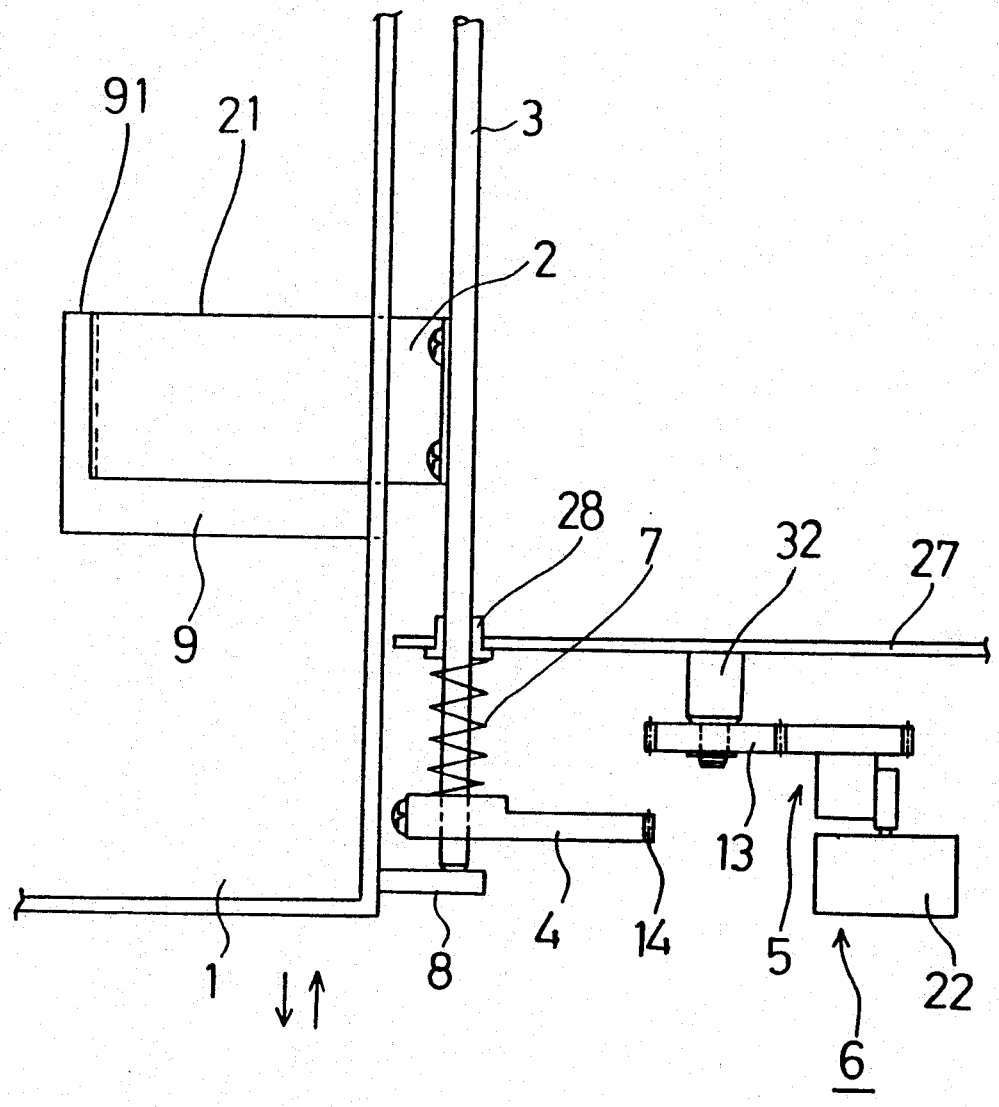
FIG. 6 is a plan view showing an arrangement where a lift gear of the present invention engages with a gear of drive means.

On the contrary, when the sheet feeding cassette 1 is inserted, as shown in FIG. 6, at the beginning the lift gear 4 has been released from the idle gear 13 by the urging force of the spring 7. Then, when the sheet feeding cassette 1 is inserted, the protrusion 8 thereof hits the edge of the lift shaft 3, and when the sheet feeding cassette 1 is further pushed against the urging force of the spring 7, the protrusion 8 moves the lift gear 4, the lift shaft 3 and lift plate 2, whereby the lift gear 4 hits and engages with the idle gear 13. When the sheet feeding cassette 1 is inserted up to a set position, the lift gear 4 engages positively with the idle gear 13 to be connected to the drive means 6, allowing the lift plate 2 to be pivoted.

Although in the above-described embodiment, the spring 7 being urging means is provided between the frame 27 and the lift gear 4, the spring 7 may be provided in any part (position) as well as such part (position) that the lift gear 4 is urged in the direction in which it is released from the gear of the drive means 6 when the sheet feeding cassette 1 is pulled out, for example, by pushing or pulling out the other end of the lift shaft 3, the lift plate 2 or the lift gear 4.

Although a spring 7 is used for the urging means of the above-described embodiment, an elastic material is sufficient which has an enough urging force to release the lift gear 4 from the gear of the drive means 5.

Figure 7:
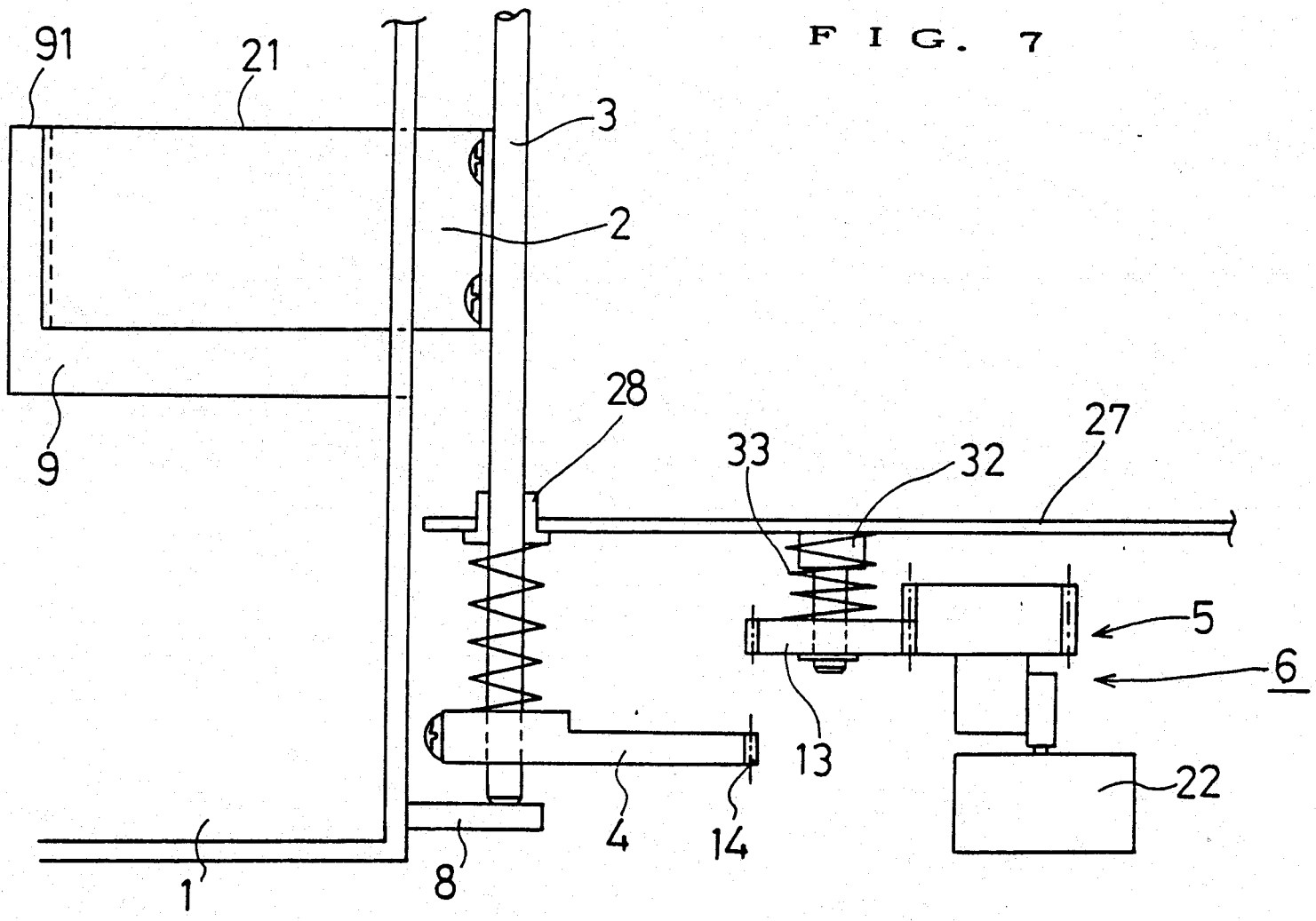
FIG. 7 is a plan view of another embodiment of the present invention.

As shown in FIG. 7, another spring 33 may be provided between the frame 27 and the idle gear 13 so that the lift gear 4 engages smoothly with the gear of the drive means 6. That is, when the sheet feeding cassette 1 is inserted and the protrusion 8 pushes one end of the lift shaft 3 to cause the lift gear 4 to come in contact with the idle gear 13, and when the tooth tip of the gear section of the lift gear 4 hits the tooth tip of the gear part of the idle gear 13, the lift gear 4 does not engage with the idle gear 13, whereby the lift gear 4 pushes the idle gear 13. Then, the idle gear 13 in a condition that it does not engage with the lift gear 4 is moved backward to the frame 27 side while compressing the spring 33. As shown in FIG. 7, the gear 5 of the drive means 6 has an enough thickness to engage with the idle gear 13 even when moved to the frame 27 side. Under such condition, when the motor 22 of the drive means 6 rotates, the idle gear 13 starts to rotate through the gear means 5, whereby the tooth tip of the gear part of the idle gear 13 is dislocated to a position of a valley part of the tooth of the lift gear 4. Then, the idle gear 13 which has been urged on the lift gear 4 side is returned to the original position while engaging with the lift gear 4.

Figure 8:
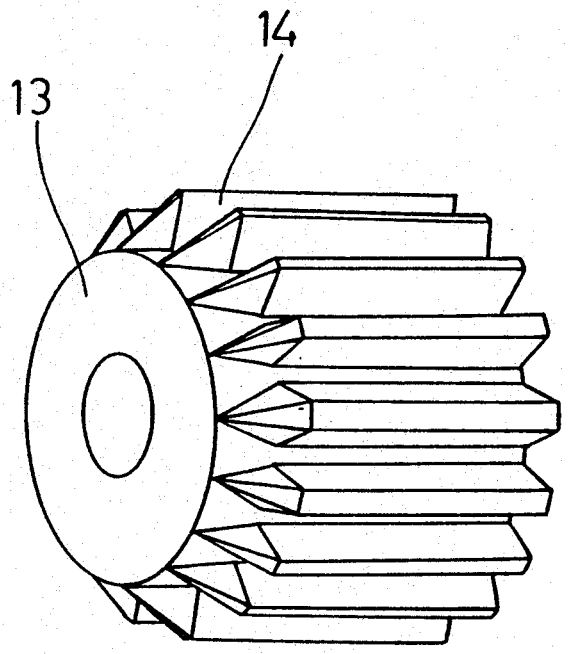
FIG. 8 is a plan view to help explain an idle gear of a further embodiment of the present invention.

As shown in FIG. 8, the gear part 14 of the idle gear 13 may be made tapered so as to provide a smooth engagement. Likewise the side face of the lift gear 4 may be made with a similar taper.

Next an embodiment of the present invention set forth in claim 2 will be described hereinafter.

Figure 9:
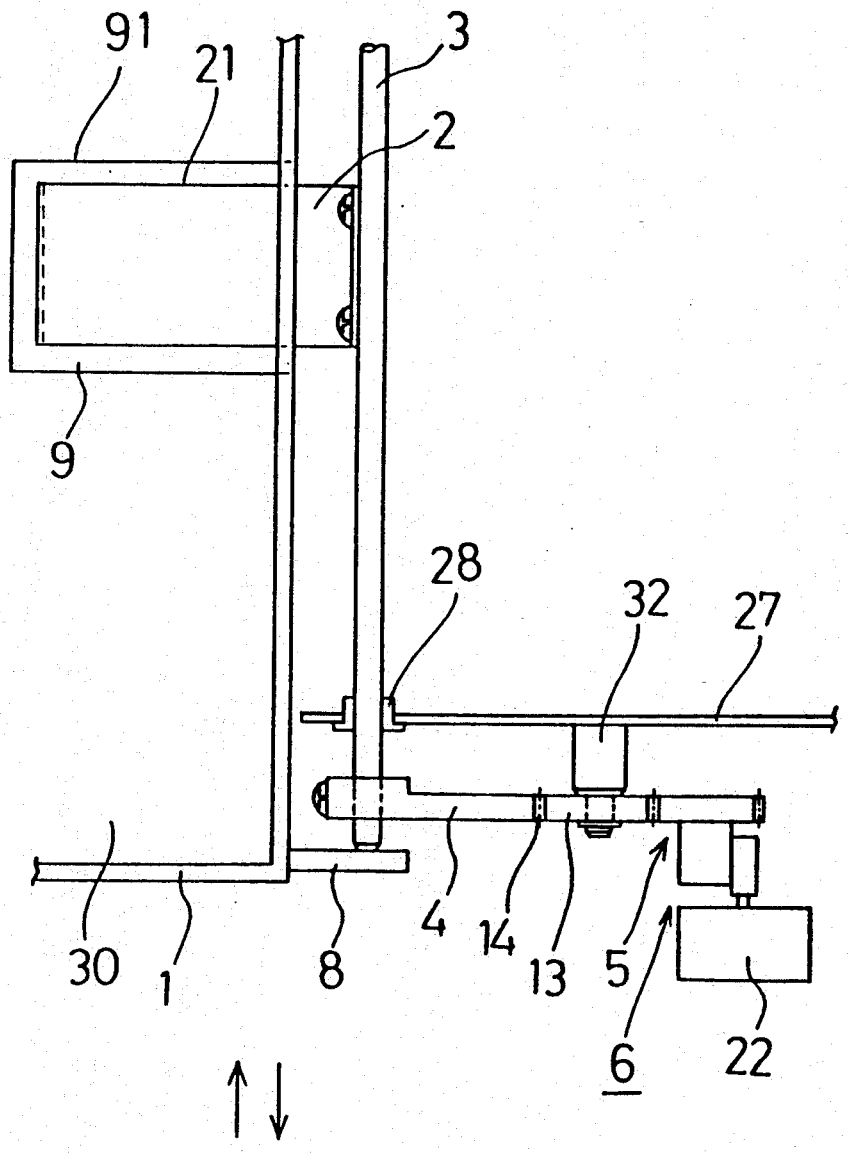
FIG. 9 is a plan view of an embodiment of the present invention.

As shown in FIG. 9, in a specified position of a frame 27, is provided a bearing 28, by which the lift shaft 3 is penetratingly held (other bearings not shown). The lift shaft 3 is formed in a manner to be movable in the direction (in the arrow direction) in which the sheet feeding cassette 1 is mounted/demounted. To the center part of the lift shaft 3 is fixed the lift plate 2 for lifting the cassette plate 12, while at an end of the lift shaft 3 is fixed the lift gear 4.

The idle gear 13 engaging with the gear section of the lift gear 4 is mounted to the fixing shaft 32 mounted to the frame 27, and further engages with the gear means 5 of the drive means 6. On part of the bottom plate 30, is provided the opening 9 wider than the width of the lift plate 2 so that the lift plate can pass through the opening 9.

The operation of the above-described embodiment will be described hereinafter.

Now assume that the sheet feeding cassette 1 has been set to the image forming apparatus as shown in FIG. 9, and the cassette plate 12 has been abutted on and lifted by a tip 31 of the lift plate 2 to feed the sheet as shown in FIG. 4. At this state, the lift gear 4 engages with the idle gear 13, whereby the lift plate 2 is locked in a lifted position.

When the sheet feeding cassette 1 is pulled out in this condition, a protrusion 8 is released from the held tip of the lift shaft 3. Even when the protrusion 8 is released from the tip of the lift shaft 3, the lift shaft 3 remains in that position and thus the lift plate 2 also remains in the same position. At this condition, when the sheet feeding cassette 1 moves to the lower position on the view, an edge 91 of the opening 9 of the bottom plate 30 abuts the edge 21 of the lifted-up lift plate 2 to cause the lift plate 2 to be pushed in the pulling out direction by the movement of the sheet feeding cassette 1. Then, the lift shaft 3 is also moved and the lift gear 4 fixed to the lift shaft 3 also moved in the pulling out direction.

The lift gear 4, when moved beyond the thickness of the lift gear 4, that is, the thickness of the idle gear 13 is released from the idle gear 13, whereby the lift gear 4 is disconnected from the drive means 6 and thus becomes rotatable. Then, the lift gear 4 is pushed down through the opening 9 to the lower side of the sheet feeding cassette 1 by the weight of the sheet and the cassette plate 12.

Thus, when the lift plate 2 returns the original position as shown in FIG. 3, the edge 91 of the opening 9 does not hit the edge 21 of the lift plate 2, whereby the sheet feeding cassette 1 can be fully pulled out without trouble.

Figure 10:
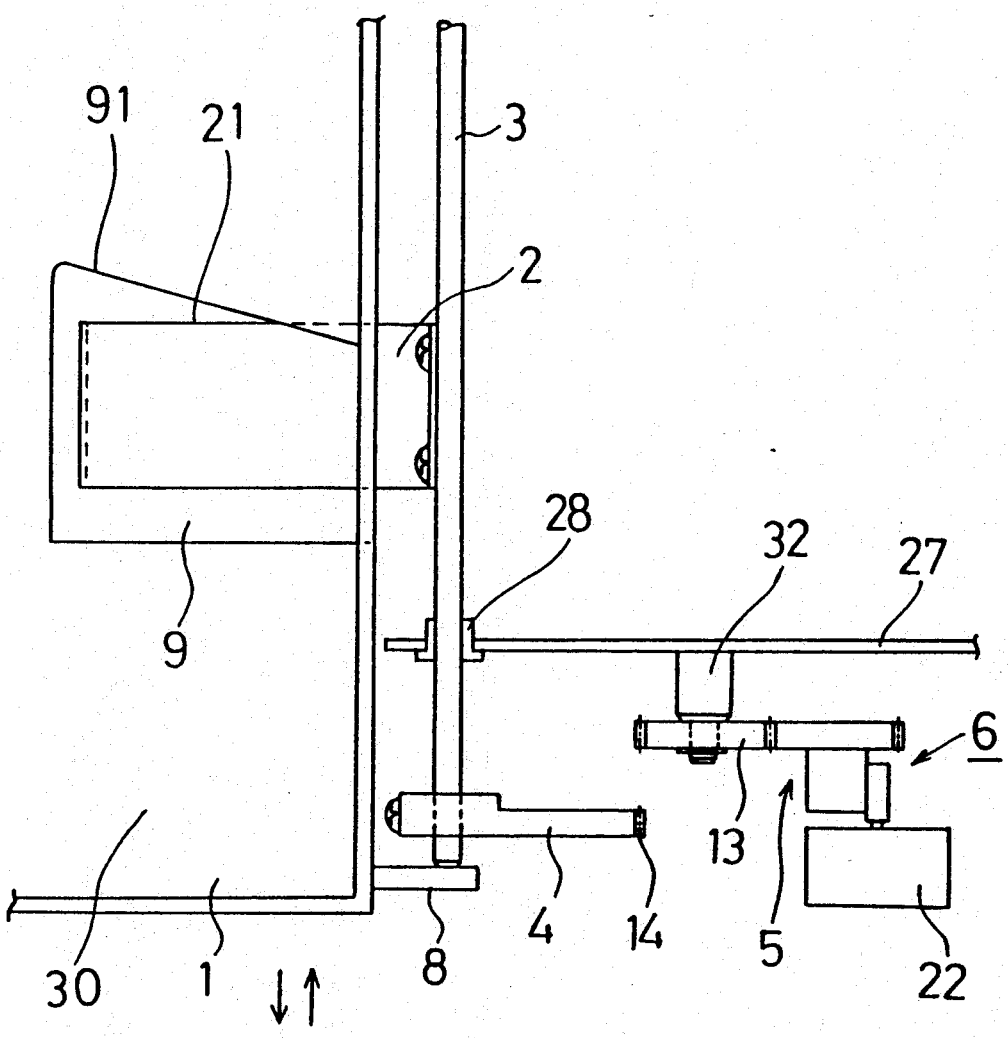
FIG. 10 is a plan view of an embodiment of the present invention.

On the contrary, when the sheet feeding cassette 1 is inserted, since the lift gear 4 has been moved by the pulling out of the sheet feeding cassette 1, the lift gear 4 remains in a condition that it has been released from the idle gear 13 (see FIG. 10).

Then, when the sheet feeding cassette 1 is inserted, the protrusion 8 thereof hits the edge of the lift shaft 3, and when the sheet feeding cassette 1 is further pushed, the protrusion 8 moves the lift gear 4, the lift shaft 3 and lift plate 2, whereby the lift gear 4 hits and engages with the idle gear 13. When the sheet feeding cassette 1 is inserted up to a set position, the lift gear 4 engages positively with the idle gear 13 to be connected to the drive means 6, allowing the lift plate 2 to be pivoted.

Figure 11:
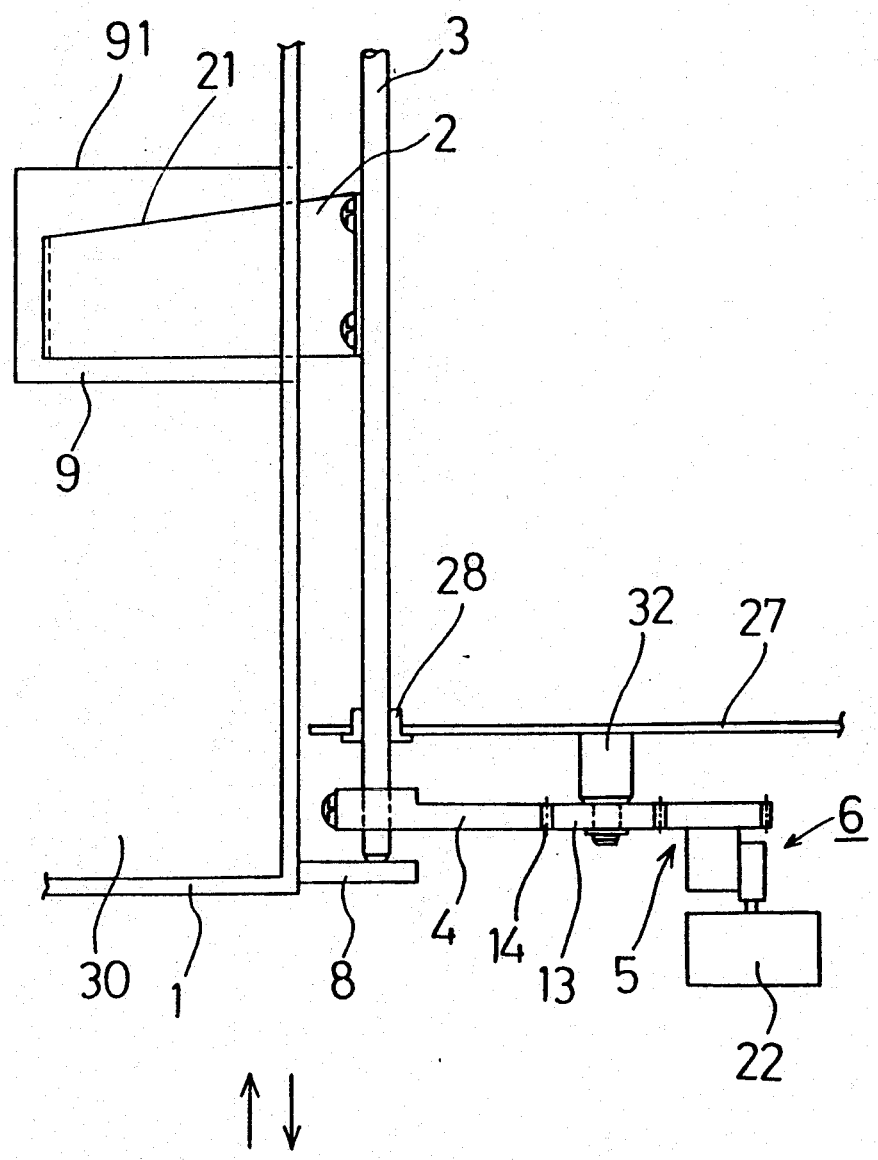
FIG. 11 is a plan view of another embodiment of the present invention.
Figure 12:
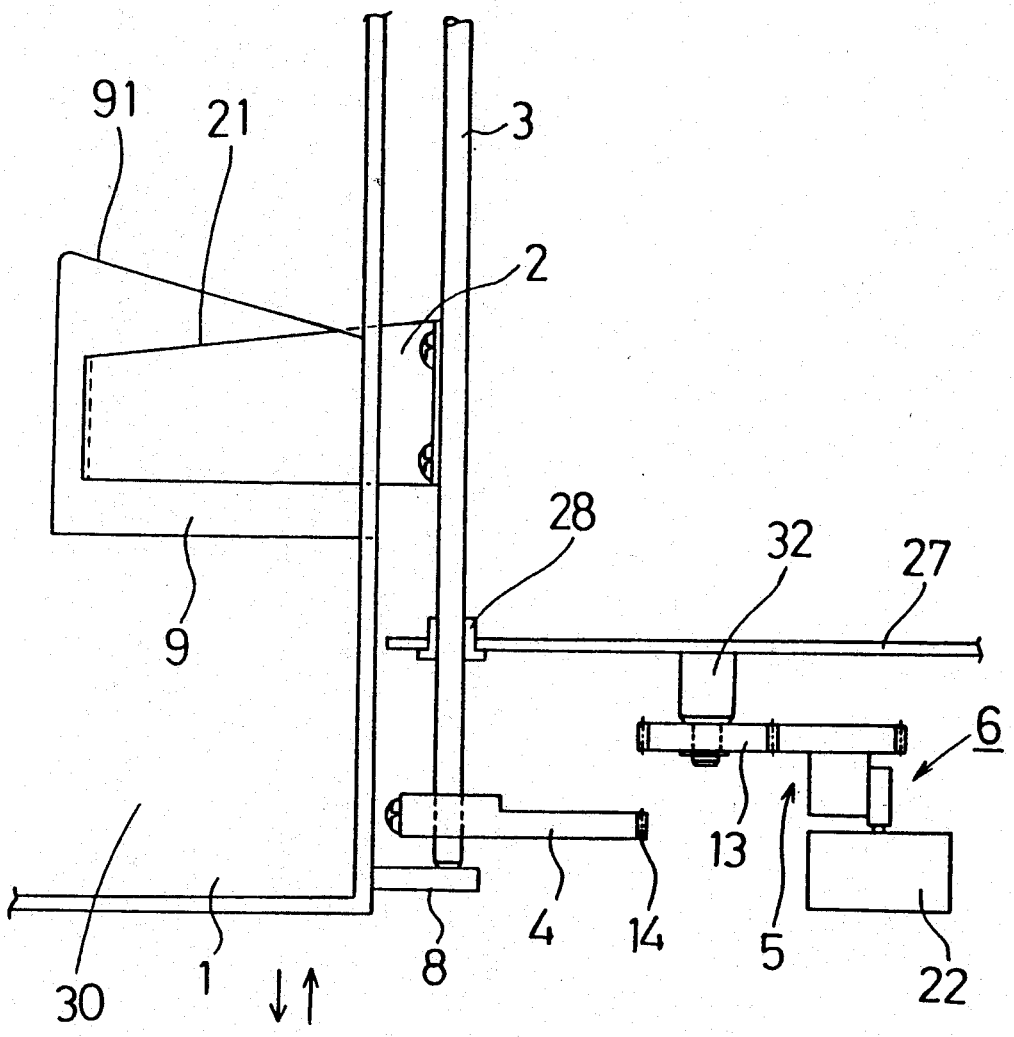
FIG. 12 is a plan view of another embodiment of the present invention.

Although in the above-described embodiment of FIG. 9, the edge 91 of the opening 9 is parallel to the edge of the lift plate 2, an inclination may be provided on the edge 91 of the opening 9 as shown in FIG. 10, or on the edge 21 of the lift plate 2 as shown in FIG. 11, or on both the edges 91 and 21 of the opening 9 and the lift plate 2 as shown in FIG. 12, so that the edge 91 of the opening 9 abuts from a side near the lift shaft 3 against the edge 21 of the lift plate 2 to cause a force pushing down the lift plate 2 to be developed.

Figure 13:
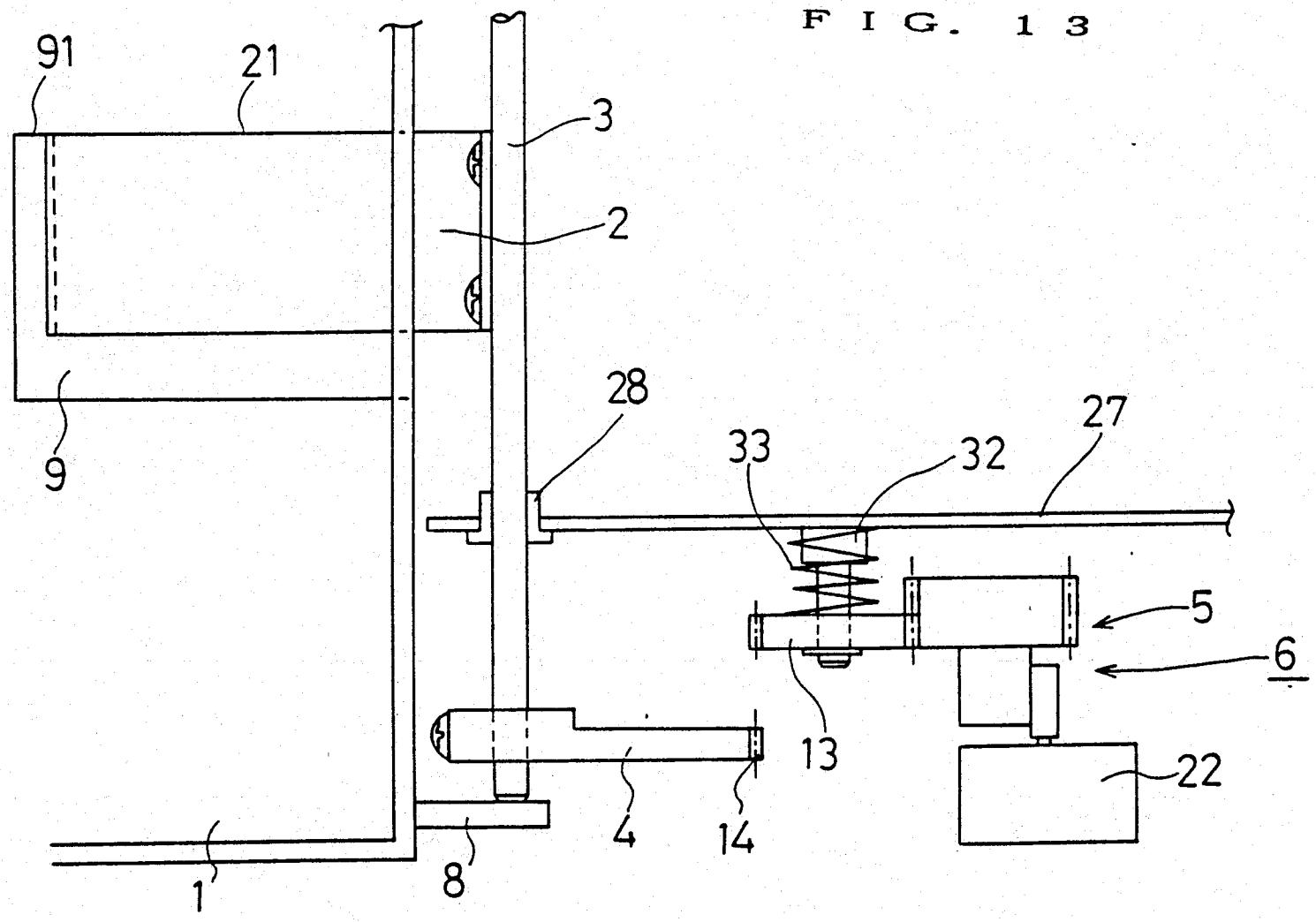
FIG. 13 is a plan view of another embodiment of the present invention.

Meanwhile as shown in FIG. 13, the idle gear 13 (as a gear of the driving means 5) may be urged at all times in a direction of the lift shaft 3 by a spring 33 (urging means).

And as shown in FIG. 8, the side face of the lift gear 4 and that of the gear part 14 of the idle gear 13 in the embodiment may be made taper shape so as to provide a smooth engagement.

With reference to drawings of FIG. 3 and FIG. 4, the present invention set forth in claim 4 will be described hereinafter.

where the drive means 6 pivots the lift gear 4 through the gear means 5 and the idle gear 13, when the lift plate 2 is positioned in the lower side position as shown in FIG. 3, a position A of the gear section 14 of the lift gear 4 engages with the idle gear 13, while when the lift plate 2 is pivoted up to a position where the lift plate 2 abuts the sheet against the pick up roller 10, a position where the gear section 14 of the lift gear 4 engages with the idle gear 13 moves to a position B.

When the above-described pivoting is performed, usually the position detection means 11 detects an upper limit position of the pick up roller 10 to stop the motor 22 of the drive means 6, thereby holding the engaging position at the position B to prevent the equipment from being damaged.

At this state, if the position detection means 11 fails it's detection, the motor 22 continues to rotate. However in the embodiment the gear section 14 of the lift gear 4 has been formed in a manner to provide an engaging part only from the position A to the position B, whereby when the engagement of the idle gear 13 with the lift gear 4 exceeds the position B, the engagement is released, that is, the lift gear 4 is not further pivoted even if the idle gear 13 continues to rotate, and accordingly, the lift plate 2, the cassette plate 12 and the pick up roller 10 are also not further lifted, providing no dangerous condition.

Although in the above-described embodiment, the allowable pivoting distance is limited by the gear section 14 of the lift gear 4, the allowable pivoting distance may also be limited by limiting a certain part of the gear part of a gear other than the driving gear, for example, the idle gear 13, with the gear section 14 of the lift gear 4 fully formed.

Meanwhile, the protrusion attached to the sheet feeding cassette can be a part of the sheet feeding cassette itself by one-body-molding method.

And the present invention can be used for copying machines, facsimiles, or printers.

As apparent by the above description, the present invention has advantages that the sheet feeding cassette can be pulled out even when the lift plate is positioned in the sheet feeding position, and that the equipment is simple in structure and inexpensive.

The lift gear or the idle gear has the gear part which is released from the gear of the drive means when the sheet reaches substantially a limit position detected by the position detection means, or a proximity position exceeding the limit position, thereby providing safety condition.

What is claimed is:

1. A sheet feeding apparatus adapted for receiving a sheet feeding cassette by insertion of said cassette into said apparatus in a first direction, said apparatus comprising:

sheet lifting means for lifting a sheet within an inserted cassette, said sheet lifting means including a lift shaft movable in said first direction and a second direction opposite said first direction, a lift plate mounted to said lift shaft, and a lift gear mounted on said lift shaft;

drive means engageable and disengageable with said lift gear for driving said lift gear, and urging means for urging at least one of said lift shaft, said lift plate and said lift gear in said second direction to disengage said lift gear from said driving means, at least one of said lift shaft, said lift gear and said lift plate being responsive to insertion of a sheet feeding cassette into said apparatus in said first direction for overcoming urging by said urging means against said at least one of said lift shaft, said lift plate, and said lift gear to thereby cause said lift gear to engage with said driving means and to maintain said lift gear with said driving means while an inserted sheet feeding cassette remains received in said apparatus, and said at least one of said lift shaft, said lift gear and said lift plate responsive to cassette insertion permitting said lift gear to disengage from said driving means upon removal of an inserted cassette.

2. A sheet feeding apparatus in accordance with claim 1, wherein said urging means is a spring attached between said lift gear and a main body frame, thereby at all times urging said lift gear in said second direction.

3. A sheet feeding apparatus in accordance with claim 1, wherein said drive means includes a gear for engaging said lift gear, said gear of said drive means being urged at all times in said second direction by a drive means gear urging means.

4. A sheet feeding apparatus in accordance with claim 1, wherein a side of said lift gear has a tapered shape.

5. A sheet feeding apparatus in accordance with claim 1, wherein said drive means includes a gear for engaging said lift gear, a side of said gear of said drive means having a tapered shape.

6. A sheet feeding apparatus in accordance with claim 1, said sheet feeding equipment is used for copying machines, facsimiles, or printers.

7. A sheet feeding apparatus adapted for receiving a sheet feeding cassette by insertion of said cassette into said apparatus in a first direction, said apparatus comprising:

a sheet feeding cassette insertable into said apparatus in said first direction, said sheet feeding cassette having a protrusion and a bottom with an opening, sheet lifting means for lifting a sheet within an inserted cassette, said sheet lifting means including a lift shaft movable in said first direction and a second direction opposite said first direction, a liftable lift plate mounted to said lift shaft, and a lift gear mounted on said lift shaft;

drive means engageable and disengageable with said lift gear for driving said lift gear, at least one of said lift shaft, said lift gear and said lift plate being responsive to pushing of said protrusion which results from insertion of said sheet feeding cassette into said apparatus in said first direction to thereby cause said lift gear to engage with said driving means and to maintain said lift gear with said driving means while an inserted sheet feeding cassette remains received in said apparatus, and at least one of said lift shaft, said lift gear and said lift plate being responsive to removal of said sheet feeding cassette in said second direction, after said lift plate has been lifted, whereby an edge of said opening pushes an edge of said lift plate in said second direction, to thereby cause said lift gear to disengage from said driving means.

8. A sheet feeding apparatus in accordance with claim 7, wherein an inclination is provided on said edge of said opening so that said edge of said opening, when pushing said edge of said lift plate, abuts said edge of said lift plate from a side near said lift shaft.

9. A sheet feeding apparatus in accordance with claim 7, wherein said drive means includes a gear for engaging said lift gear, said gear of said drive means is urged at all times in said second direction by a drive means gear urging means.

10. A sheet feeding apparatus in accordance with claim 7, wherein a side of said lift gear has a tapered shape.

11. A sheet feeding equipment in accordance with claim 7, said sheet feeding equipment is used for copying machines, facsimiles, or printers.

12. A sheet feeding apparatus in accordance with claim 7, wherein said drive means includes a gear for engaging said lift gear, a side of said gear of said driving means having a tapered shape.

13. A sheet feeding apparatus in accordance with claim 7, wherein an inclination is provided on said edge of said lift plate so that said edge of said opening, when pushing said edge of said lift plate, abuts said edge of said lift plate from a side near said lift shaft.

14. A sheet feeding apparatus in accordance with claim 7, wherein an inclination is provided on both said edge of said opening and said edge of said lift plate so that said edge of said opening, when pushing said edge of said lift plate, abuts said edge of said lift plate from a side near said lift shaft.

15. A sheet feeding apparatus comprising: a pick up roller for feeding a sheet, position detection means for detecting a limit position of said sheet, a cassette plate on which a sheet is placed, a lift plate for lifting said cassette plate, a lift gear means for pivoting said lift plate, and drive means for driving said lift gear, said lift gear means having a gear part which is released from a gear of said drive means when said sheet reaches substantially said limit position detected by said position detection means.

16. A sheet feeding apparatus in accordance with claim 15, wherein said lift gear means is released from said gear of said drive means by limiting an area of a tooth part of said lift gear means.

17. A sheet feeding apparatus in accordance with claim 15, said sheet feeding equipment is used for copying machines, facsimiles, or printers.

18. A sheet feeding apparatus adapted for receiving a sheet feeding cassette by insertion of said cassette into said apparatus in a first direction, said apparatus comprising:

a sheet feeding cassette insertable into said apparatus in said first direction, said sheet feeding cassette having a protrusion, sheet lifting means for lifting a sheet within an inserted cassette, said sheet lifting means including a lift shaft movable in said first direction and a second direction opposite said first direction, a lift plate mounted to said lift shaft, and a lift gear mounted on said lift shaft;

drive means engageable and disengageable with said lift gear for driving said lift gear, and urging means for urging at least one of said lift shaft, said lift plate and said lift gear in said second direction to disengage said lift gear from said driving means, at least one of said lift shaft, said lift gear and said lift plate being responsive to pushing of said protrusion from insertion of said sheet feeding cassette into said apparatus in said first direction for overcoming urging by said urging means against said at least one of said lift shaft, said lift plate, and said lift gear to thereby cause said lift gear to engage with said driving means and to maintain said lift gear with said driving means while an inserted sheet feeding cassette remains received in said apparatus, and said at least one of said lift shaft, said lift gear and said lift plate responsive to cassette insertion permitting said lift gear to disengage from said driving means upon cessation of pushing of said protrusion from removal of said inserted cassette.

19. A sheet feeding apparatus in accordance with claim 18, wherein said urging means is a spring attached between said lift gear and a main body frame, thereby at all times urging said lift gear in said second direction.

20. A sheet feeding apparatus in accordance with claim 18, wherein said drive means includes a gear for engaging said lift gear, said gear of said drive means being urged at all times in said second direction by a drive means gear urging means.

21. A sheet feeding apparatus in accordance with claim 18, wherein a side of said lift gear has a tapered shape.

22. A sheet feeding apparatus in accordance with claim 18, wherein said drive means includes a gear for engaging said lift gear, a side of said gear of said drive means having a tapered shape.

23. A sheet feeding apparatus in accordance with claim 18, wherein said sheet feeding equipment is used for copying machines, facsimiles, or printers.

* * * * *